US011562612B2

(12) United States Patent
Höschen

(10) Patent No.: US 11,562,612 B2
(45) Date of Patent: Jan. 24, 2023

(54) DEVICE FOR HANDLING NOTES OF VALUE AND METHOD FOR OPERATING A DEVICE FOR HANDLING NOTES OF VALUE

(71) Applicant: Wincor Nixdorf International GmbH, Pderbom (DE)

(72) Inventor: Hermann Höschen, Paderborn (DE)

(73) Assignee: Wincor Nixdorf International GmbH, Paderborn (DE)

( * ) Notice: Subject to any disclaimer, the term of this patent is extended or adjusted under 35 U.S.C. 154(b) by 309 days.

(21) Appl. No.: 15/931,117

(22) Filed: Jul. 16, 2020

(65) Prior Publication Data

US 2020/0364964 A1 Nov. 19, 2020

(30) Foreign Application Priority Data

May 14, 2019 (EP) ..... 19174321

(51) Int. Cl.
*G07D 11/13* (2019.01)
*G07F 7/04* (2006.01)

(52) U.S. Cl.
CPC ..... *G07D 11/13* (2019.01); *G07F 7/04* (2013.01)

(58) Field of Classification Search
CPC ..... G07D 11/13; G07D 11/22; G07D 11/50; G07D 2211/00; G07F 7/04; B65H 2701/1912
USPC ..... 235/379
See application file for complete search history.

(56) References Cited

U.S. PATENT DOCUMENTS

2005/0006458 A1* 1/2005 Wanibe ..... G07D 7/121 235/379
2016/0350995 A1* 12/2016 Mizuno ..... G07D 7/003
2019/0333308 A1* 10/2019 Whytock ..... G07D 11/16

FOREIGN PATENT DOCUMENTS

DE 102006058549 A1 6/2008
DE 202007018498 U1 11/2008
DE 102009006810 A1 8/2010
DE 102010036571 A1 1/2012
DE 102011000797 A1 8/2012
EP 0811208 A1 12/1997

OTHER PUBLICATIONS

Extended European Search Report, published Nov. 18, 2019, written in German language.

* cited by examiner

*Primary Examiner* — Suezu Ellis
(74) *Attorney, Agent, or Firm* — Black McCuskey

(57) ABSTRACT

Shown is a device for handling notes of value, with an input/output compartment, a pull-off and separating device, an intermediate storage unit comprising a drum storage, at least one cash box, a transport device for the transport of notes of value between the afore-mentioned units, and a control unit. The control unit is configured to control the transport device such that notes of value that are to be stored in the cash box are fed to the drum storage and are intermediately stored thereat, and these notes of value are again taken from the intermediate storage unit after receipt of a confirmation information, are fed to the cash box and are stored therein.

20 Claims, 4 Drawing Sheets

DEVICE FOR HANDLING NOTES OF VALUE AND METHOD FOR OPERATING A DEVICE FOR HANDLING NOTES OF VALUE

CROSS-REFERENCE TO RELATED APPLICATIONS

This application claims priority to and the benefit of EP19174321.0, which was filed on May 14, 2019.

BACKGROUND AND SUMMARY

The invention relates to a device for handling notes of value with an input/output compartment, a pull-off and separating device, an intermediate storage unit comprising a drum storage, at least one cash box, a transport device for the transport of notes of value between the afore-mentioned units, and a control unit. The control unit is configured to control the transport device such that notes of value that are to be stored in the cash box are fed to the drum storage and are intermediately stored thereat, and these notes of value are again removed from the intermediate storage unit after receipt of a confirmation information, are fed to the cash box and stored therein.

The invention further relates to a method for operating a device for handling notes of value, in which notes of value provided to the device via an input/output compartment are separated, the separated notes of value are identified and checked for at least one safety feature. All checked notes of value are fed to a drum storage of an intermediate storage unit and are intermediately stored thereat. Notes of value that have been checked positive for the safety feature are taken from the drum storage, fed to a cash box and stored therein.

Known devices for handling notes of value have so-called retract compartments for storing non-removed notes of value. When, for example, notes of value to be dispensed have not or not completely been removed, these are transported back to the device and stored in one of the retract compartments. Here, it is necessary to store the non-removed notes of value physically separated from other notes of value so that the non-removed notes of value may be assigned in an unambiguous manner later on because an account had already been debited with the amount of the notes of value transported to the input/output compartment. At present, however, at most two to three such retracts may be performed because in known devices only a limited amount of retract compartments is available. After two or three retract transactions, the device is no longer operational. Further, the provision of retract compartments requires relatively much installation space which is already scarce in most devices for handling notes of value anyway.

Document DE 10 2011 000 797 A1 discloses a device for handling notes of value with two intermediate storages for intermediately storing the notes of value. The device comprises a sensor unit for determining at least one feature of each note of value and a switch which feeds the respective note of value to the one or the other intermediate storage depending on the determined feature.

From document DE 10 2010 036 571 A1, a method for depositing notes of value into a device for handling notes of value with a virtual intermediate storage is known. Here, two value note storages arranged in a safe are used as a virtual intermediate storage.

Document DE 10 2006 058 549 A1 discloses a device for handling banknotes with an intermediate storage for intermediately storing banknotes. The intermediate storage comprises several transport elements which form an endless transport path for intermediately storing banknotes fed to the device.

Document DE 10 2010 016 810 A1 discloses a device for intermediately storing at least one value note container.

It is the object of the invention to specify a device for handling notes of value and a method for operating such a device, in which several retracts may easily be handled.

This object is solved by a device having the features disclosed herein and a method having the features disclosed herein. Advantageous developments are also specified herein.

In the device according to claim 1, the control unit is configured to control the transport device such that notes of value which are to be stored separately from notes of value in the cash box are fed to the drum storage and are permanently stored thereat. The control unit is further configured to advance the drum storage, after storing the notes of value to be permanently stored, such that a safe physical separation between the notes of value to be permanently stored and subsequently intermediately stored notes of value or notes of value to be permanently stored is given.

Drum storages, also referred to as foil storages or winding storages, for storing notes of value usually have two foil belts wound around winding drums, which belts may be wound jointly on one winding drum, the notes of value to be stored being inserted between the foil belts upon winding on the third drum. The storage capacity of such drum storages amounts to several hundred notes of value. Thus, it is possible to store a large number of retracted notes of value in the drum storage. Compared to conventional retract compartments, the drum storage further has the advantage that a retract compartment is fully occupied even in the case of a retract of only one note of value, while such a retract hardly reduces the storage capacity of the drum storage. Since retracts usually only comprise a few notes of value, the use of the drum storage of the intermediate storage enables the storage of a large number of retracts in the drum storage. Thus, the device according to claim 1 remains operational even after several retracts, in particular after more than three retracts.

The drum storage of the device according to claim 1 thus has two functions. On the one hand, it serves as an intermediate storage, also referred to as escrow, for notes of value as long as a confirmation information for a storage in the cash box has not been received yet. On the other hand, it serves as a permanent storage for notes of values which are to be stored separately from notes of value in the cash box. As a result, installation space is saved in the device.

It is advantageous when the device comprises a checking device, and the control unit is configured to control the pull-off and separating device such that notes of value provided to the device via the input/output compartment are separated, and to control the checking device such that the separated notes of value are identified and checked for at least one safety feature. Further, the control unit is configured to control the transport device such that all checked notes of value are fed to the drum storage of the intermediate storage unit and are intermediately stored thereat, and that notes of value that are checked positive for the safety feature are removed from the drum storage and transported to the cash box and stored therein.

In this embodiment, notes of value that have been checked negative for the safety feature, i.e. counterfeit notes of value or notes of value suspected to be counterfeit, are separated from notes of value that have been checked positive for the safety feature, i.e. genuine notes of value. The counterfeit notes of value and the notes of value suspected to be counterfeit should be stored separately from the notes of value in the cash box. The intermediate storage unit thus also serves as a permanent storage for the counterfeit notes of value and the notes of value suspected to be counterfeit. As a result, further installation space is saved in the device. A further advantage of this embodiment is that the counterfeit notes of value and the notes of value suspected to be counterfeit are protected from access in the drum storage. At the same time, however, no safe key is required to remove the counterfeit notes of value or the notes of value suspected to be counterfeit from the device.

Further, it is advantageous when the control unit controls the transport device such that notes of value that have been checked negative for the safety feature are transported from the drum storage to the input/output compartment and are intermediately stored therein. After storing the notes of value that have been checked positive for the safety feature in the cash box, then the notes of value that have been checked negative for the safety feature are transported from the input/output compartment to the drum storage and are permanently stored thereat.

As a result, at first all notes of value are intermediately stored so that a confirmation information may be queried before the notes of value are stored in the cash box. When a negative confirmation information is received, i.e. when for example a deposit operation is to be interrupted, for example only those notes of value that have been checked positive for the safety feature may be transported back to the input/output compartment and provided for output therein. The counterfeit notes of value and the notes of value suspected to be counterfeit are permanently stored in the drum storage in this embodiment. Alternatively, upon receipt of a negative confirmation information all intermediately stored notes of value may be transported back to the input/output compartment and provided for output therein.

Further, it is advantageous when the device comprises the checking device and when the control unit is configured to control the pull-off and separating device such that notes of value provided to the device via the input/output compartment are separated. The control unit is further configured to control the checking device such that the separated notes of value are identified and their respective denomination is determined. The control unit is further configured to control the transport device such that all checked notes of value are fed to a drum storage of an intermediate storage unit and are intermediately stored therein, that notes of value of at least one predetermined denomination are transported from the drum storage to the input/output compartment and are intermediately stored therein, that the remaining notes of value are taken from the drum storage, are transported to the cash box and are stored therein, and that after storing the remaining notes of value in the cash box, the notes of value of the at least one predetermined denomination are transported from the input/output compartment to the drum storage and are permanently stored thereat.

This embodiment makes it possible to permanently store rare denominations, such as 200 Euro or 500 Euro notes. The notes of value of the rare denominations are protected from immediate access in the drum storage, without additional cash boxes or compartments having to be provided in a safe area. As a result, further installation space is saved.

Further, it is advantageous when the control unit is configured to advance the drum storage, after storing the notes of value to be permanently stored, such that the minimum distance between the last note of value of the notes of value to be permanently stored and the first note of value of the subsequently intermediately stored notes of value is three to twenty times, preferably five to ten times a preset minimum distance between two successively stored intermediately stored notes of value so that a safe physical separation between the permanently stored notes of value and the subsequently intermediately stored notes of value exists. As a result, a mixing of the intermediately stored notes of value, for example of a current deposit into the device, with the notes of value to be permanently stored is safely prevented.

In the present application, distance between two notes of value in the drum storage means the distance between two facing edges of two notes of value immediately successively stored in the drum storage. With other words, the distance between two immediately successively stored notes of value is equal to the distance between a rear edge of the note of value first stored in the drum storage and a front edge of the note of value subsequently stored in the drum storage.

In the present application, the minimum distance means the distance which two notes of value at least have to one another. Since notes of value have different sizes, the distance between two notes of value successively stored in the drum storage does not necessarily always have the same value. Keeping the minimum distance between two immediately successive notes of value stored in the drum storage can, for example, be achieved in that the two notes of value are stored in the drum storage such that their front edges or rear edges have a predefined distance to each other.

The invention further relates to a method of the above-mentioned type having the features of claim 6, in which notes of value that have been checked negative for the safety feature are transported from the drum storage to the input/output compartment and are intermediately stored therein. After storing the notes of value that have been checked positive for the safety feature in the cash box, the notes of value that have been checked negative for the safety feature are transported from the input/output compartment to the drum storage and are permanently stored thereat. After permanently storing the notes of value that have been checked negative for the safety feature, the drum storage is then advanced so that a safe physical separation between the permanently stored notes of value and subsequently intermediately stored notes of value is created.

The method has the same advantages as the claimed device and can be developed in the same manner, in particular with the features of the dependent claims.

In a preferred embodiment, the notes of value that have been checked positive for the safety feature are only removed from the drum storage after receipt of a confirmation information, are transported to the cash box and are stored in the cash box.

In a further preferred embodiment, after feeding notes of value to be permanently stored, the drum storage is advanced such that the minimum distance between the last note of value of the notes of value to be permanently stored and the first note of value of the subsequently intermediately stored notes of value is three to twenty times, preferably five to ten times a preset minimum distance between two successively stored intermediately stored notes of value so that a safe physical separation between the permanently stored notes of value and the subsequently intermediately stored notes of value is created.

In an alternative embodiment, after feeding notes of value to be permanently stored, the drum storage is advanced by a predetermined angle, preferably by half a turn or a full turn of the wind-up drum so that a safe physical separation between the notes of value that are permanently stored and the subsequently intermediately stored notes of value is created.

In a further preferred embodiment, notes of value to be dispensed are taken from a cash box of the device and stored in the input/output compartment. After a preset provision time, notes of value remaining in the input/output compartment are transported from the input/output compartment to the intermediate storage unit and are permanently stored thereat. After permanently storing the notes of value that have remained in the input/output compartment in the drum storage, the latter is advanced so that a safe physical separation between the permanently stored notes of value and the successively intermediately stored notes of value is created.

Further features and advantages result from the following description which in connection with the enclosed Figures explains the invention in more detail on the basis of embodiments.

BRIEF DESCRIPTION OF THE DRAWINGS

In the figures,

FIG. 2-1 shows a first portion of a flow chart of a sequence for operating the device according to FIG. 1, in which notes of value are fed to the device;

FIG. 2-2 shows a second portion of the flow chart of FIG. 2-1; and

DETAILED DESCRIPTION

Figure 1:
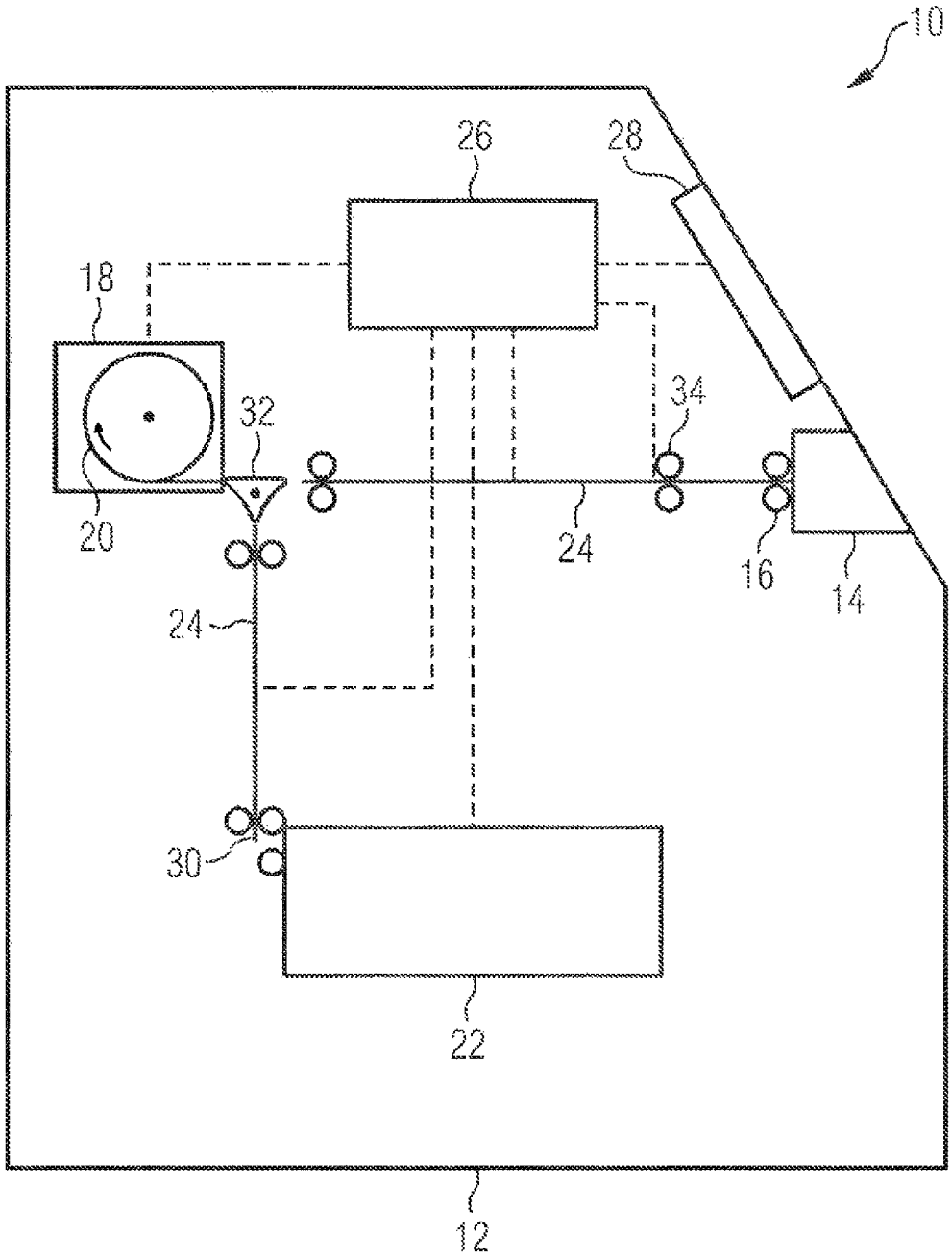
FIG. 1 shows a schematic illustration of a device for handling notes of value.

FIG. 1 shows a schematic illustration of a device 10 for handling notes of value. The device 10 comprises a housing 12. Within the housing 12, an input/output compartment 14, a pull-off and separating device 16, an intermediate storage unit 18 comprising a drum storage 20, a cash box 22, a transport device 24 for the transport of notes of value between the afore-mentioned units, and a control unit 26 are arranged. Further, a control panel 28 for the input of a confirmation information is arranged above the input/output compartment 14.

The input/output compartment 14 is connected to the transport device 24 via the pull-off and separating device 16. As a result, notes of value provided to the device 10 via the input/output compartment 14 can be pulled off, separated and transported to the various units of the device 10.

The device 10 comprises a feed and removal unit 30 for the pull-off of notes of value from the cash box 22 and for feeding individual notes of value into the cash box 22.

The transport device 24 comprises a switch 32. The switch 32 is configured to deflect notes of value coming from the input/output compartment 14 either in the direction of the cash box 22 or the intermediate storage 18 as well as notes of value coming from the intermediate storage unit 18 either in the direction of the cash box 22 or the input/output compartment 14. The switch 32 is further configured to deflect notes of value coming from the cash box 22 in the direction of the input/output compartment 14. The transport device further comprises a checking device 34 which is connected to the control unit 26 and configured to identify the separated notes of value, i.e. in particular to determine their denomination, and preferably to check them for at least one safety feature.

The control unit 26 is connected to the intermediate storage unit 18, the cash box 22, the transport device 24 and the control panel 28. The control unit 26 is configured to control the transport device 24 such that notes of value which are to be stored in the cash box 22 are fed to the drum storage 20 of the intermediate storage unit 18 and are intermediately stored thereat, and these notes of value, after receipt of the confirmation information input via the control panel 28, are again removed from the intermediate storage unit 18, are fed to the cash box 22 and are permanently stored therein. The control unit 26 is further configured to control the transport device 24 such that notes of value which are to be stored separately from notes of value in the cash box 22 are fed to the drum storage 20 and are permanently stored thereat, and to advance the drum storage 20 has shown by turning in the direction of the arrow in FIG. 1), after storage of the notes of value to be permanently stored, such that a safe physical separation between the notes of value to be permanently stored and subsequently intermediately stored notes of value exists. The notes of value to be permanently stored may in particular be counterfeit notes of value or notes of value suspected to be counterfeit or notes of value that have not been taken from the input/output compartment 14.

Figures 1, 2:
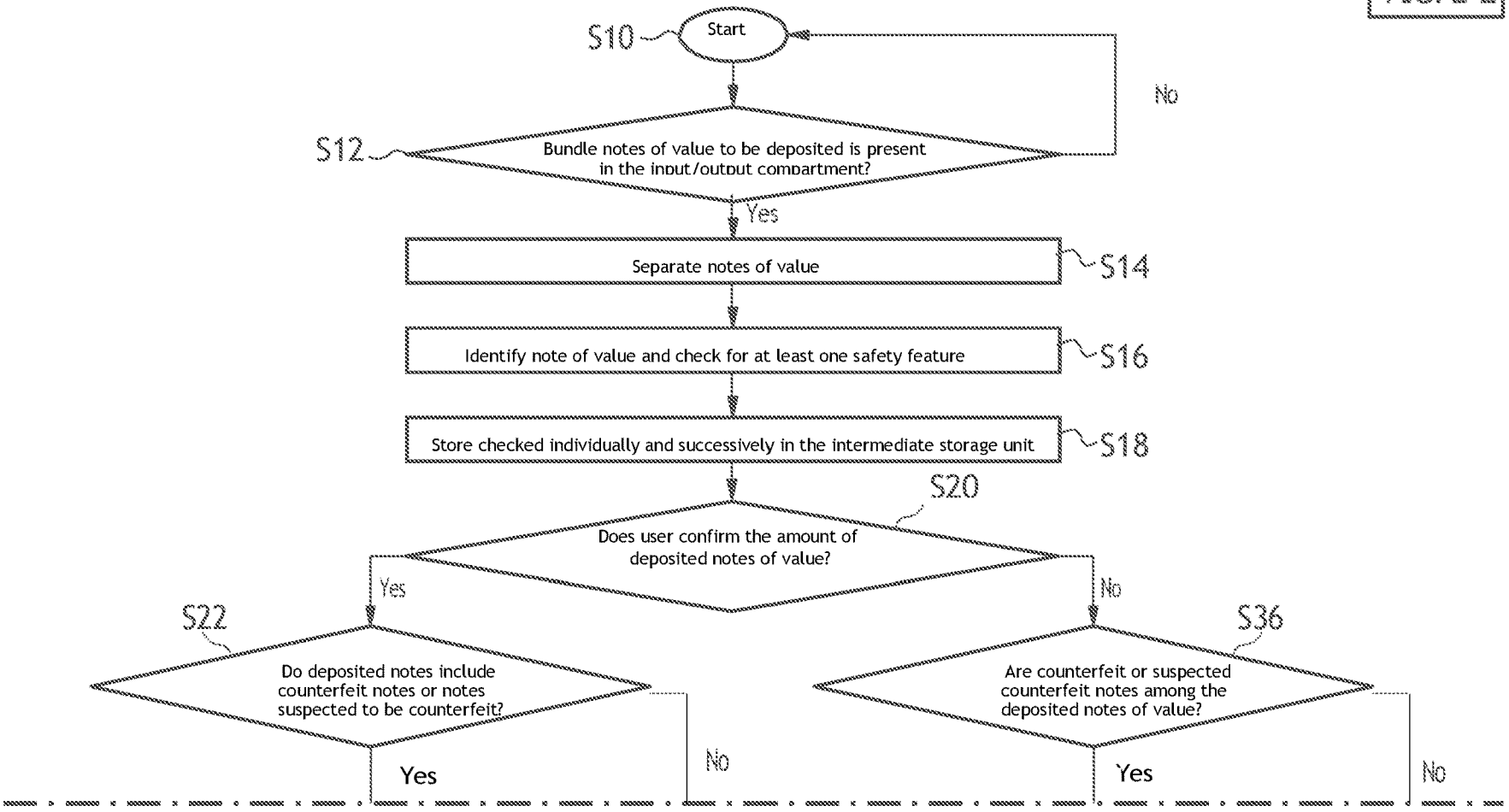
Figure 2:
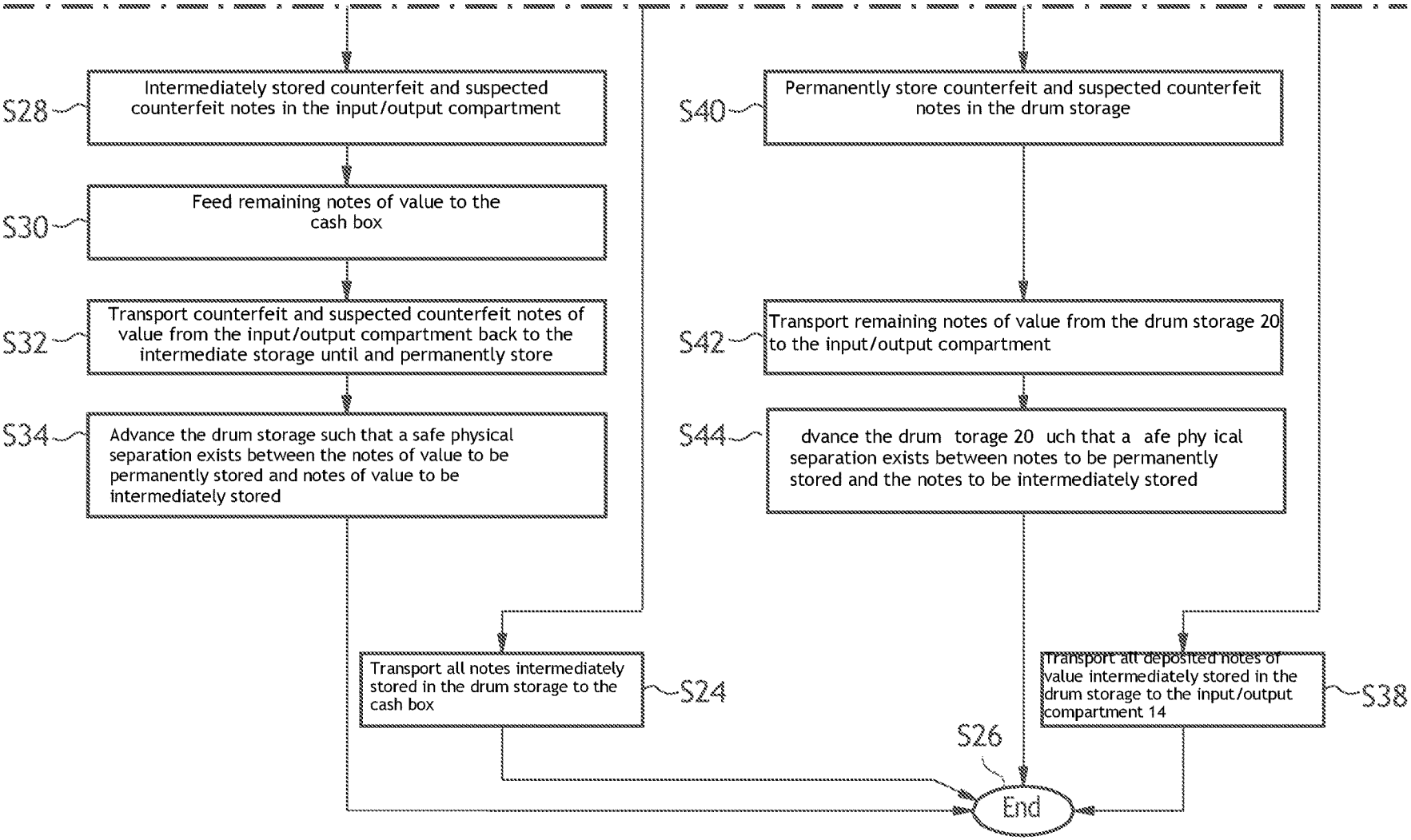

FIG. 2 shows a flow chart of a sequence for operating the device 10 according to FIG. 1, in which notes of value are fed to the device 10 via the input/output compartment 14. Thus, the sequence of FIG. 2 relates to a deposit operation.

The sequence is started in step S10. In a following step S12, it is checked whether a bundle of notes of value to be deposited is present in the input/output compartment 14. If a bundle of notes of value is present, this is separated in step S14. The separated notes of value are individually fed to the checking device 34. The checking device 34 performs a value note identification in step S16 and checks each note of value for at least one safety feature. In step S18, the checked notes of value are individually successively stored in the intermediate storage unit 18.

In step S20, this confirmation information is queried via the control panel 28. This means, for example, that a user is prompted via the control panel 28 to confirm the total amount of the deposited notes of value determined in step S16.

When a positive confirmation information is detected, i.e. the user for example confirms the total amount of the deposited notes of value, then it is checked in step S22 whether in step S16 counterfeit notes of value or notes of value suspected to be counterfeit had been determined among the deposited notes of value. If no counterfeit notes of value or notes of value suspected to be counterfeit had been determined, all deposited notes of value intermediately stored in the drum storage 20 are transported to the cash box 22 by means of the transport device 24 and stored thereat in step S24. Subsequently, the sequence is terminated in step S26.

When among the deposited notes of value counterfeit notes of value or notes of value suspected to be counterfeit had been determined, these are at first, in step S28, intermediately stored in the input/output compartment 14 closed at this point in time. Subsequently, the remaining notes of value are fed to the cash box 22 in step S30 and stored therein. In step S32, the counterfeit notes of value or the notes of value suspected to be counterfeit are transported from the input/output compartment 14 back to the intermediate storage unit 18 and are permanently stored thereat. In step S34, the drum storage 20 is advanced such that a safe physical separation between the notes of value to be permanently stored and subsequently intermediately stored notes of value exists. Subsequently, the sequence is terminated in step S26.

If no confirmation information is detected or if a negative confirmation information is detected, i.e. the user for example does not confirm the value of the deposited notes of value or the user cancels the operation, then it is checked in step S36 whether in step S16 counterfeit notes of value or notes of value suspected to be counterfeit had been determined among the deposited notes of value. If no counterfeit notes of value or notes of value suspected to be counterfeit had been determined, then in step S38 all deposited notes of value intermediately stored in the drum storage 20 are transported to the input/output compartment 14 by means of the transport device 24 and provided thereat for withdrawal. If among the deposited notes of value counterfeit notes of value or notes of value suspected to be counterfeit have been determined, these are permanently stored in the drum storage 20 in step S40. Thereafter, in step S42 the remaining notes of value are taken from the drum storage 20, are transported to the input/output compartment 14 and provided thereat for withdrawal. In step S44, the drum storage 20 is advanced such that a safe physical separation between the notes of value to be permanently stored and subsequently intermediately stored notes of value exists. Subsequently, the sequence is terminated in step S26.

Figure 3:
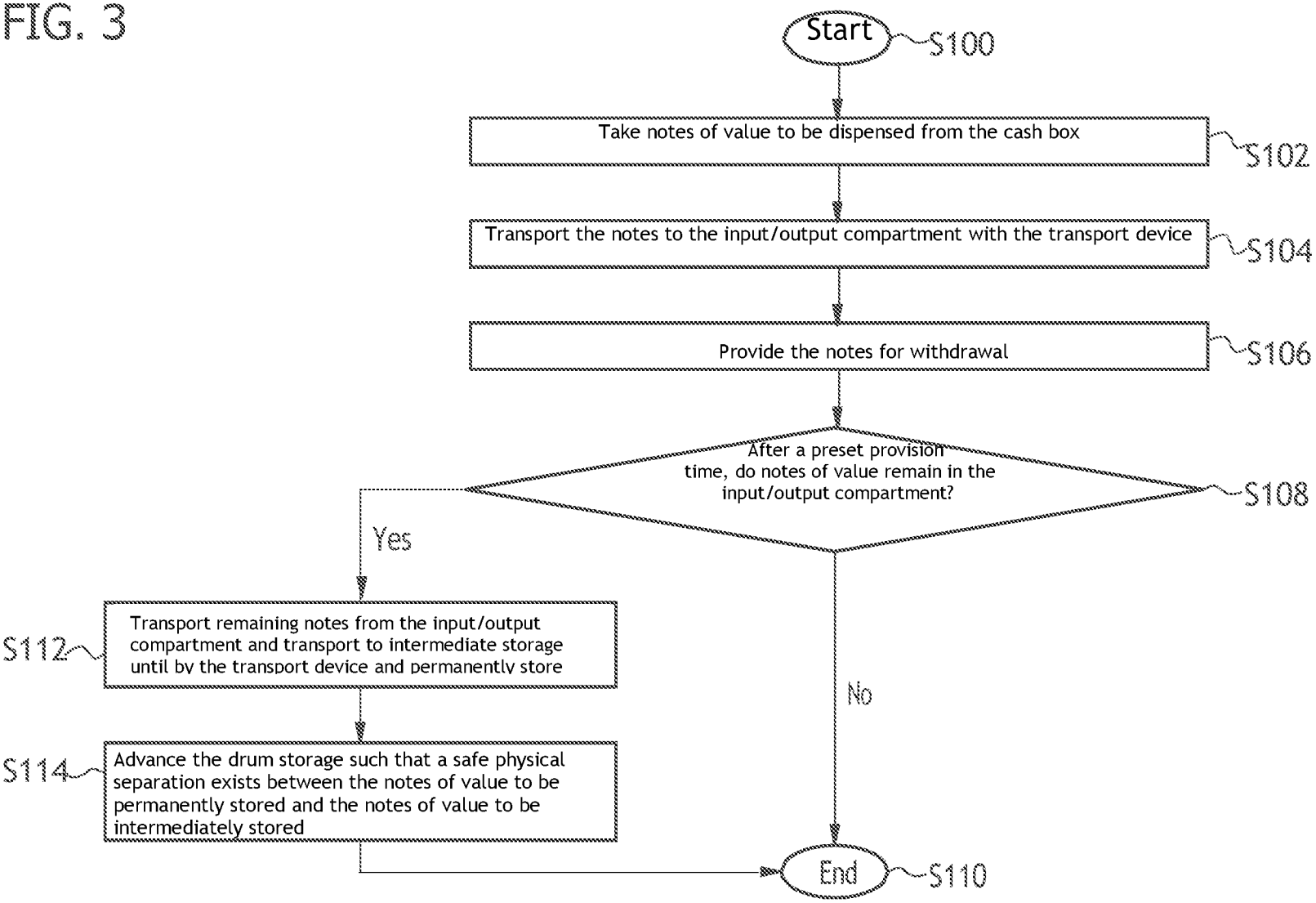
FIG. 3 shows a flow chart of a further sequence for operating the device according to FIG. 1, in which notes of value for withdrawal are provided to the device.

FIG. 3 shows a flow chart of a further sequence for operating the device 10 according to FIG. 1, in which the device 10 provides notes of value for withdrawal. Thus, the sequence of FIG. 3 relates to a withdrawal operation.

The sequence is started in step S100. In a following step S102, notes of value to be dispensed are taken from the cash box 22. These are separated by means of the feed and removal unit 30 and fed to the transport device 24. In step S104, the notes of value to be dispensed are transported to the input/output compartment 14 by means of the transport device 24 and provided thereat for withdrawal from the device 10 in step S106.

After a preset provision time, it is checked in step S108 whether notes of value have remained in the input/output compartment 14. If no notes of value have remained in the input/output compartment 14, the sequence is terminated in step S110. When notes of value have remained in the input/output compartment 14, these are taken from the input/output compartment 14 in step S112, are transported to the intermediate storage unit 18 by the transport device 24 and permanently stored thereat. In step S114, the drum storage 20 is advanced such that a safe physical separation between the notes of value to be permanently stored and subsequently intermediately stored notes of value exists. Subsequently, the sequence is terminated in step S110.

The invention claimed is:

1. A device for handling notes of value, with an input/output compartment, a pull-off and separating device, an intermediate storage unit comprising a drum storage, at least one cash box, a transport device for the transport of notes of value between the afore-mentioned units, and a control unit, wherein the control unit is configured to control the transport device such that notes of value which are to be stored in the at least one cash box are fed to the drum storage and are intermediately stored thereat, and these notes of value are again removed from the intermediate storage unit after receipt of a confirmation information, are fed to the at least one cash box and are stored therein, wherein the control unit is further configured to control the transport device such that notes of value which are to be stored separately from notes of value in the at least one cash box are fed to the drum storage and are permanently stored thereat, and wherein, after storage of the notes of value to be permanently stored, the control unit is further configured to advance the drum storage by turning the drum storage such that a safe physical separation between the notes of value to be permanently stored and subsequently intermediately stored notes of value exists.

2. The device according to claim 1 further comprising a checking device, and wherein the control unit is further configured to control the pull-off and separating device such that notes of value provided to the device via the input/output compartment are separated, wherein the control unit is further configured to control the checking device such that the separated notes of value are identified and checked for at least one safety feature, and wherein the control unit is further configured to control the transport device such that all checked notes of value are fed to the drum storage of the intermediate storage unit and are intermediately stored thereat, and that notes of value that have been checked positive for the safety feature are taken from the drum storage and are transported to the at least one cash box and are stored therein.

3. The device according to claim 2, wherein the control unit controls the transport device such that notes of value that have been checked negative for the safety feature are transported from the drum storage to the input/output compartment and are intermediately stored therein, and wherein the control unit is further configured, after storage of the notes of value that have been checked positive for the safety feature in the at least one cash box, to control the transport device to transport the notes of value that have been checked negative for the safety feature from the input/output compartment to the drum storage and are permanently stored thereat.

4. The device according to claim 1 further comprising a checking device wherein the control unit is further configured to control the pull-off and separating device such that notes of value provided to the device via the input/output compartment are separated, wherein the control unit is further configured to control the checking device such that the separated notes of value are identified and their respective denomination is determined, and wherein the control unit is further configured to control the transport device such that all checked notes of value are fed to the drum storage of the intermediate storage unit and are intermediately stored thereat, wherein the control unit is further configured to control the transport device to transport notes of value of at least one predetermined denomination from the drum storage to the input/output compartment wherein these notes of value are intermediately stored therein, wherein the control unit is further configured to control the transport device to transport the remaining notes of value from the drum storage to the at least one cash box and wherein the remaining notes of value are stored therein, and wherein the control unit is further configured to control the transport device to transport, after storage of the remaining notes of value in the at least one cash box, the notes of value of the at least one predetermined denomination from the input/output compartment to the drum storage.

5. The device according to claim 1 wherein the control unit is further configured to control the transport device such that notes of value to be dispensed from the device are taken from the at least one cash box of the device and transported to the input/output compartment, and wherein the control unit is further configured to control the transport device to transport notes of value remaining in the input/output compartment after a preset provision time from the input/output compartment to the intermediate storage unit.

6. The device according to claim 1, wherein the control unit is further configured to advance the drum storage after storage of the notes of value to be permanently stored such that a minimum distance between a last note of value of the notes of value to be permanently stored and a first note of value of subsequently intermediately stored notes of value is three to twenty times a preset minimum distance between two successively stored intermediately stored notes of value.

7. A method for operating a device for handling notes of value comprising:

receiving, with the device, a first plurality of notes of value from a user via an input/output compartment of the device;

separating, with a pull-off and separating device of the device, the received first plurality of notes of value;

checking, with a checking device of the device, after said separating, each of the first plurality of notes of value for at least one safety feature, wherein a note of value of said first plurality of notes of value is checked negative for the at least one safety feature when the note of value is counterfeit or suspected to be counterfeit and is checked positive otherwise;

feeding, with a transport device of the device, after said checking, all of the first plurality of notes of value to a drum storage of an intermediate storage unit of the device to be intermediately stored thereat;

feeding, with the transport device, all of the first plurality of notes of value that are intermediately stored on the drum storage and that have been checked positive for the at least one safety feature from the drum storage to a cash box of the device;

transporting, with the transport device, all of the first plurality of notes of value that are intermediately stored on the drum storage and have been checked negative for the at least one safety feature from the drum storage to the input/output compartment;

transporting, with the transport device, after said feeding all of the first plurality of notes of value that have been checked positive for the at least one safety feature to the cash box, all of the first plurality of notes of value that have been checked negative for the at least one safety feature from the input/output compartment back to the drum storage to be permanently stored thereat;

positioning each of the respective first plurality of notes of value that have been checked negative for the at least one safety feature on the drum storage a first distance apart from one another;

storing at least one note of value of a second plurality of notes of value on the drum storage adjacent to and spaced a second distance apart from a last note of value of the first plurality of notes of value that have been checked negative for the at least one safety feature and positioned on said drum storage during said positioning; and after said transporting all of the first plurality of notes of value that have been checked negative back to the drum storage, advancing the drum storage by turning the drum storage such that a safe physical separation is defined between the last of the first plurality of notes of value that have been checked negative and stored on the drum storage and the at least one note of value of the second plurality of notes of value such that the second distance is greater that the first distance.

8. The method according to claim 7, wherein the first plurality of notes of value that have been checked positive for the at least one safety feature are removed from the drum storage only after receipt of a confirmation information and are then transported to the cash box and are stored therein.

9. The method according to claim 7 wherein the second distance is three to twenty times the first distance.

10. The method according to claim 7 wherein the second distance corresponds to half a turn or a full turn of the drum storage.

11. The method according to claim 7 further comprising:

transporting, with the transport device, a third plurality of notes of value to be dispensed to a user of the device from the cash box and to the input/output compartment;

transporting, with the transport device, after said transporting the third plurality of notes of value to the input/output compartment, any notes of value of the third plurality of notes of value remaining in the input/output compartment after a preset provision time from the input/output compartment to the drum storage of the intermediate storage unit to be permanently stored thereat; and storing at least one note of value of a fourth plurality of notes of value on the drum storage adjacent to and spaced the second distance apart from a last note of value of the remaining notes of value of the third plurality of notes of value.

12. A method for operating a note-handling device:

receiving a plurality of first notes of value via an input/output compartment of the note-handling device;

checking, with a checking device of the note-handling device, each of the plurality of first notes of value for at least one safety feature, wherein a note of value of said plurality of first notes of value is checked negative for the at least one safety feature when the note of value is counterfeit or suspected to be counterfeit and is checked positive otherwise;

positioning each of the respective plurality of first notes of value that have been checked negative for the at least one safety feature on a drum storage of the note-handling device a first distance apart from one another;

receiving at least one second note of value via the input/output compartment; and storing the at least one second note of value on the drum storage adjacent to and spaced a second distance apart from a last note of value of the plurality of first notes of value that have been checked negative for the at least one safety feature, wherein the second distance is greater that the first distance.

13. The method of claim 12 wherein the second distance is three to twenty times the first distance.

14. The method of claim 12 wherein the second distance is five to ten times the first distance.

15. The method of claim 12 wherein said storing further comprises:

rotating the drum storage half of a full turn to create the second distance.

16. The method of claim 12 wherein said storing further comprises:

rotating the drum storage a full turn to create the second distance.

17. The method of claim 12 further comprising:

identifying, with the checking device, a denomination of at least one of the plurality of first notes of value that is checked positive;

positioning the at least one of the plurality of first notes of value that is identified during said identifying on the drum storage;

receiving at least one third note of value via the input/output compartment; and storing the at least one third note of value on the drum storage adjacent to and spaced the second distance apart from the at least one of the plurality of first notes of value that is identified during said identifying.

18. The method of claim 17 wherein the second distance is three to twenty times the first distance.

19. The method of claim 17 wherein the second distance is five to ten times the first distance.

20. The method of claim 12 further comprising:

transporting, with a transport device, at least one third note of value to be dispensed to a user of the device from a cash box of the note-handling device to the input/output compartment;

transporting, with the transport device, after said transporting the at least one third note of value to the input/output compartment, the third note of value remaining in the input/output compartment after a preset provision time from the input/output compartment to the drum storage to be permanently stored thereat; and storing the third note of value adjacent to and spaced the second distance apart from a last note of value stored on the drum storage.

* * * * *